US011122921B2

(12) United States Patent
Heit

(10) Patent No.: US 11,122,921 B2
(45) Date of Patent: Sep. 21, 2021

(54) SYSTEMS AND METHODS FOR AN ILLUMINATING, DRINK INSULATING DEVICE

(71) Applicant: NITE IZE, INC., Boulder, CO (US)

(72) Inventor: Joshua Heit, Westminster, CO (US)

(73) Assignee: NITE IZE, INC., Boulder, CO (US)

( * ) Notice: Subject to any disclaimer, the term of this patent is extended or adjusted under 35 U.S.C. 154(b) by 0 days.

(21) Appl. No.: 16/428,644

(22) Filed: May 31, 2019

(65) Prior Publication Data

US 2019/0374056 A1 Dec. 12, 2019

Related U.S. Application Data

(63) Continuation-in-part of application No. 29/650,704, filed on Jun. 8, 2018.

(51) Int. Cl.

| | |
|---|---|
| ***A47G 23/00*** | (2006.01) |
| ***A47G 23/02*** | (2006.01) |
| ***A45F 5/00*** | (2006.01) |

(52) U.S. Cl.

CPC ..... *A47G 23/0266* (2013.01); *A45F 5/00* (2013.01); *A47G 23/0216* (2013.01); *A45F 2005/002* (2013.01); *A45F 2200/0583* (2013.01); *A47G 2023/0291* (2013.01); *A47G 2200/08* (2013.01)

(58) Field of Classification Search

CPC .... A45F 5/00; A47G 23/0266; A47G 23/0216

See application file for complete search history.

(56) References Cited

U.S. PATENT DOCUMENTS

| | | | | |
|---|---|---|---|---|
| 4,886,183 | A * | 12/1989 | Fleming | A47G 23/0266 220/739 |
| 8,814,379 | B2 * | 8/2014 | Griffiths | B65D 23/12 362/101 |
| 9,420,908 | B1 * | 8/2016 | White | A47G 19/2288 |
| 2001/0030858 | A1 | 10/2001 | Krietzman et al. | |
| 2003/0106895 | A1 * | 6/2003 | Kalal | B65D 81/3893 220/9.2 |
| 2003/0210141 | A1 * | 11/2003 | Iacovino | G08B 7/068 340/539.1 |
| 2004/0014384 | A1 | 1/2004 | Sloot | |
| 2005/0024858 | A1 * | 2/2005 | Johnson | A47G 19/2227 362/154 |

(Continued)

FOREIGN PATENT DOCUMENTS

CN 202302948 U 7/2012

OTHER PUBLICATIONS

International Search Report and Written Opinion dated Jan. 31, 2020 issued in related PCT App. No. PCT/US2019/063792 (12 pages).

*Primary Examiner* — Gerald J Sufleta, II

(74) *Attorney, Agent, or Firm* — Haynes and Boone, LLP

(57) ABSTRACT

A beverage container lighting and insulation device includes a first piece of insulating material. The beverage container lighting and insulation device further includes a spring oriented along a length of the insulating material, such that the spring causes the first piece of insulating material to coil. The beverage container lighting and insulation device further includes a lighting device joined with the first piece of insulating material, such that the lighting device lights the length of the first piece of insulating material.

20 Claims, 4 Drawing Sheets

(56) References Cited

U.S. PATENT DOCUMENTS

| | | | | |
|---|---|---|---|---|
| 2006/0076376 | A1* | 4/2006 | Kemery | G08B 5/38 224/222 |
| 2009/0217492 | A1 | 9/2009 | Gallant et al. | |
| 2010/0258601 | A1* | 10/2010 | Thrope | A45C 1/00 224/267 |
| 2014/0000984 | A1 | 1/2014 | Thornton | |
| 2015/0069096 | A1* | 3/2015 | Kampas | A45F 5/00 224/148.6 |
| 2016/0290624 | A1 | 10/2016 | Dai et al. | |

* cited by examiner

SYSTEMS AND METHODS FOR AN ILLUMINATING, DRINK INSULATING DEVICE

CROSS REFERENCE TO RELATED APPLICATIONS

This application is a continuation-in-part and claims priority to U.S. Design application Ser. No. 29/650,704, filed on Jun. 8, 2018, which is hereby incorporated by reference.

BACKGROUND

From barbeques and cookouts, camping and sporting event, to the comfort of one's home there is the desire to keep drinks cool. Additionally, in low light conditions it is desirable to be able to find one's drink. Numerous drink cozies exist that are generally composed of neoprene or other materials, but it may be difficult to remove and attach such items to drinks.

BRIEF SUMMARY

In one embodiment, a beverage container lighting and insulation device includes a first piece of insulating material. The beverage container lighting and insulation device further includes a spring oriented along a length of the insulating material, such that the spring causes the first piece of insulating material to coil. The beverage container lighting and insulation device further includes a lighting device joined with the first piece of insulating material, such that the lighting device lights the length of the first piece of insulating material. In one alternative, the lighting device includes a momentary switch. In another alternative, the momentary switch is located beneath the first piece of insulating material, such that a user presses on the first piece of insulating material to actuate the momentary switch. Alternatively, the lighting device includes a light transmitting material that runs the length of the first piece of insulating material and the light transmitting material is adjacent to a light in the lighting device. In another alternative, the light is an LED and the light transmitting material is Flexible Polymer (TPU Thermal Plastic Urethane or TPE or Thermal Plastic Elastomer). Optionally, the lighting device includes a battery harness and a circuit board, the battery harness holding batteries under the circuit board. In one alternative, the beverage container lighting and insulation device further includes a second piece of insulating material, the first and second pieces of insulating material sandwiching the spring. Alternatively, the spring includes a first and second bi-stable spring. In another alternative, a first and second reinforcing material is located at both ends of the first and second bi-stable spring. In one alternative, the beverage container lighting and insulation device further includes a shell, the shell positioned on the first insulating material and the lighting device located between the shell and the first insulating material. In one alternative, the beverage container lighting and insulation device further includes, a joining film, wherein the light transmitting material is located in a cutout of the joining film. Alternatively, the first insulating material and the shell a joined at one end via a hook and loop fabric system and the shell includes a tab that is part of the hook and loop fabric system, providing for the removable insertion of the lighting device.

In one embodiment, a beverage container lighting and insulation device includes a first piece of insulating material. The beverage container lighting and insulation device further includes a first and second bi-stable springs; oriented along a length of the insulating material, such that the first and second bi-stable springs cause the first piece of insulating material to coil. The beverage container lighting and insulation device further includes a lighting device joined with the first piece of insulating material, such that the lighting device lights the length of the first piece of insulating material. In one alternative, the lighting device includes a momentary switch and the momentary switch is located beneath the first piece of insulating material, such that a user presses on the first piece of insulating material to actuate the momentary switch. In another alternative, the lighting device includes a light transmitting material that runs the length of the first piece of insulating material and the light transmitting material is adjacent to a light in the lighting device and the light is an LED and the light transmitting material is Flexible Polymer (TPU Thermal Plastic Urethane or TPE or Thermal Plastic Elastomer). Alternatively, a first and second reinforcing material is located at both ends of the first and second bi-stable spring. In one alternative, the beverage container lighting and insulation device further includes, a shell, the shell positioned on the first insulating material and the lighting device located between the shell and the first insulating material and a joining film, wherein the light transmitting material is located in a cutout of the joining film. Alternatively, the first insulating material and the shell a joined at one end via a hook and loop fabric system and the shell includes a tab that is part of the hook and loop fabric system, providing for the removable insertion of the lighting device.

In one embodiment, a method of insulating a beverage container includes providing a beverage container lighting and insulation device, including a first piece of insulating material. The beverage container lighting and insulation device further includes a spring oriented along a length of the insulating material, such that the spring causes the first piece of insulating material to coil. The beverage container lighting and insulation device further includes a lighting device joined with the first piece of insulating material, such that the lighting device lights the length of the first piece of insulating material. The method further includes wrapping of slapping the beverage container lighting and insulation device around a beverage container. The method further includes the beverage container lighting and insulation device with a force provided by the coiling of the beverage container lighting and insulation device and friction between the beverage container lighting and insulation device and the beverage container. Optionally, the method further includes activating the lighting device using a momentary switch by pushing on an exterior shell of the beverage container lighting and insulation device.

DETAILED DESCRIPTION

Certain terminology is used herein for convenience only and is not to be taken as a limitation on the embodiments of the systems and methods for an illuminating, drink insulating device (referred to as IDID herein). Generally, embodiments of IDIDs include an insulating system, an attachment system, and an illuminating system. Therefore, IDIDs may provide insulation to a normal size drink, such as a can, and may provide illumination as well. Generally, the insulating system includes various neoprene layers that wrap around the drink container. Generally, the attachment system includes one or more bi-stable springs that provide for wrapping around the drink container. Generally, the illumination system includes an LED system that has a light transmission piece for illuminating along the length of the IDID.

Figure 1A:
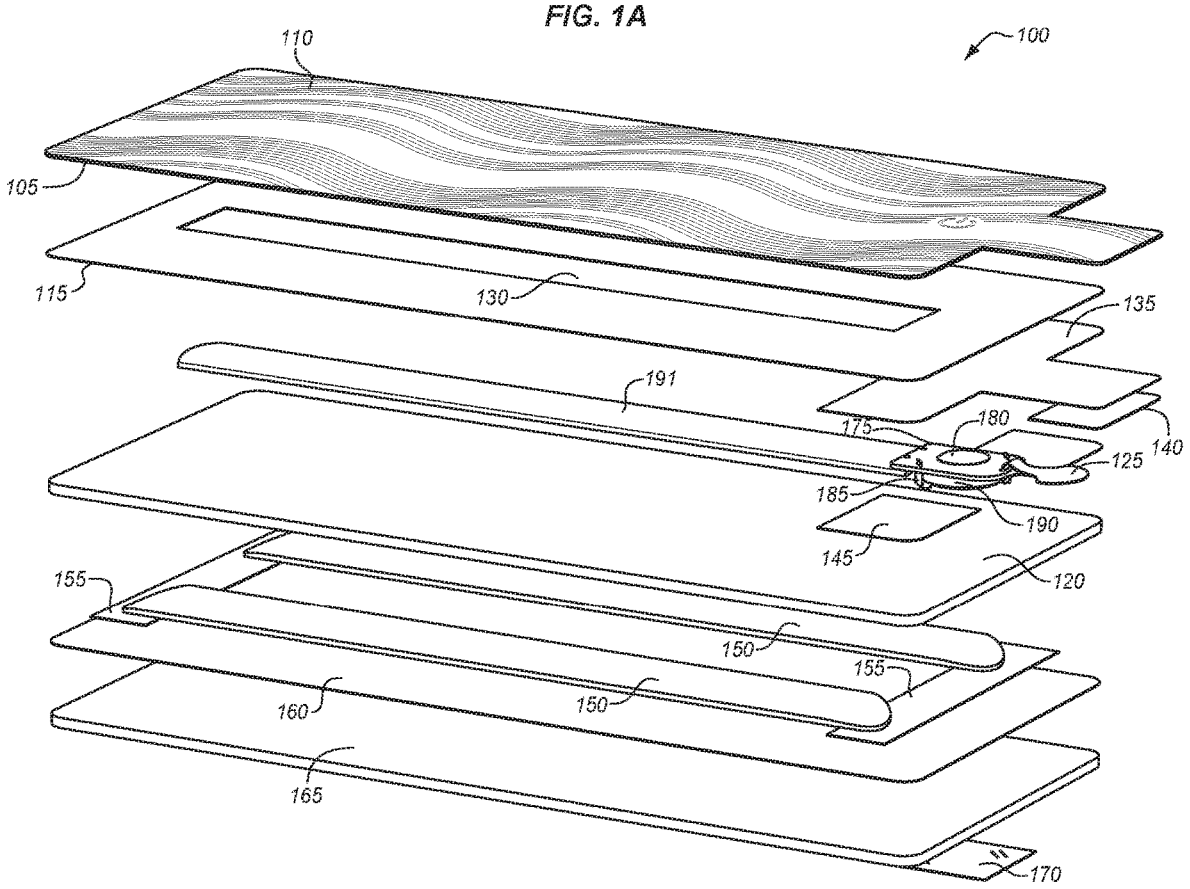
FIG. 1A shows an exploded view of one embodiment of an illuminating, drink insulating device.

FIG. 1A shows an exploded view of one embodiment of an IDID 100. IDID 100 includes an outward facing shell 105 of Lycra fabric material. Shell 105 includes a graphical silk screen 110 on the outward facing side of the material. Any pattern or design may be included on the silk screen 110. The next layer down is a TPU joining film 115 that provides for holding of the shell to the inner insulator 120. Inner insulator may be formed of foam rubber or other flexible insulating material. In between inner insulator 120 and joining film 115 is LED light module 125. Joining film 115 includes a cut out 130 for receiving LED light module 125. Reinforcement material 135 joins with hook portion of Velcro® connector 140. On the other side of LED light module 125 is a reinforcing material 145. This helps to prevent pressure on the LED light module 125 from tearing or degrading the inner insulator 120. Typically, the reinforcing material is a sheet of polyester fabric, however, various materials may be used. On the opposite side of inner insulator 120 are two bi-stable springs 150 that provide for the IDID 100 to wrap around a can or other drink container. On either ends of the two bi-stable springs 150, more reinforcing material 155 is provided. Then a sheet of TPU joining material 160 is provided to join the springs 150 and inner insulator 120 to the outer insulating material 165. This outer insulating material 165 is typically foam rubber as it provides for insulation and friction against the can or bottle. On the outward facing side of outer insulating material 165, a Velcro® loop portion 170 is provided. In this way, hook portion 140 may attach to loop portion 170 and therefore hold LED light module 125 in the interior of the device. Therefore, in operation, IDID 100 may be held in a straightened position with bi-stable springs 150 in a straight configuration. The device may then be slapped/wrapped around a bottle or can the bi-stable springs 150 will release their straight position and wrap around the can or other beverage container. LED light module 125 includes a single button activator 180 in the form of momentary switch. LED light module 125 further includes a circuit board 175, a battery harness 185, batteries 190, and a light transmitting material 191, oriented to receive light from the LED and transmit it down the length of the device. Typically, light transmitting material is made of Flexible Polymer (TPU Thermal Plastic Urethane or TPE or Thermal Plastic Elastomer) or other material that is largely transparent but has edges that provide for some measure of internal reflection, such that light travels down the length of the light transmitting material 191.

Therefore, in many embodiments, the IDID includes a lighting module that runs the length of the device. The lighting module includes a light transmission material, to transmit light from one end of the device to the other, while partially emitting it. The lighting module includes a momentary switch for single button, on/off operation. The lighting module may be removable for replacement of the batteries. The IDID includes insulating material. In many embodiments, this is foam rubber. The IDID includes at least one internal bi-stable spring. This spring provides for the flexing of the material around a can. Light transmitting fabric provides the projection of light through the device from the lighting module, especially the light transmitting material. The light transmitting material may be Flexible Polymer (TPU Thermal Plastic Urethane or TPE or Thermal Plastic Elastomer). The light transmitting material, the foam rubber, the fabric and other portions of the device are flexible so that they may be wrapped around the can or other drink container. Therefore, the IDID is a wrappable, easily removable lighting and insultation device.

Additionally, in many embodiments, the IDID includes a mechanism for wrapping around a cup or can. Typically, the IDID will be rectangular when flattened, however other shapes are possible. Typically, the wrapping mechanism is the result of bi-stable springs, however other springs may be used including those that do not have bi-stability. Springs that merely wrap/coil and do not have the ability to maintain a straightened position may be used. In some embodiments, the material that the IDID is made up of may itself be coiling in nature. Therefore, no internal springs may be needed. Various lighting mechanisms are possible that include multiple LEDs. In many embodiments, the ability to actuate the lighting mechanism through the body of the IDID, by depressing a body portion and activating a momentary switch is used. In other embodiments, the momentary switch is exposed, outside of the body of the IDID. Alternatively, a different type of switch may be used. In various embodiments, foam rubber is used for insulation. In alternatives, various insulating materials may be used. In some embodiments, neoprene or other waterproof shells are used on the device.

Figure 1B:
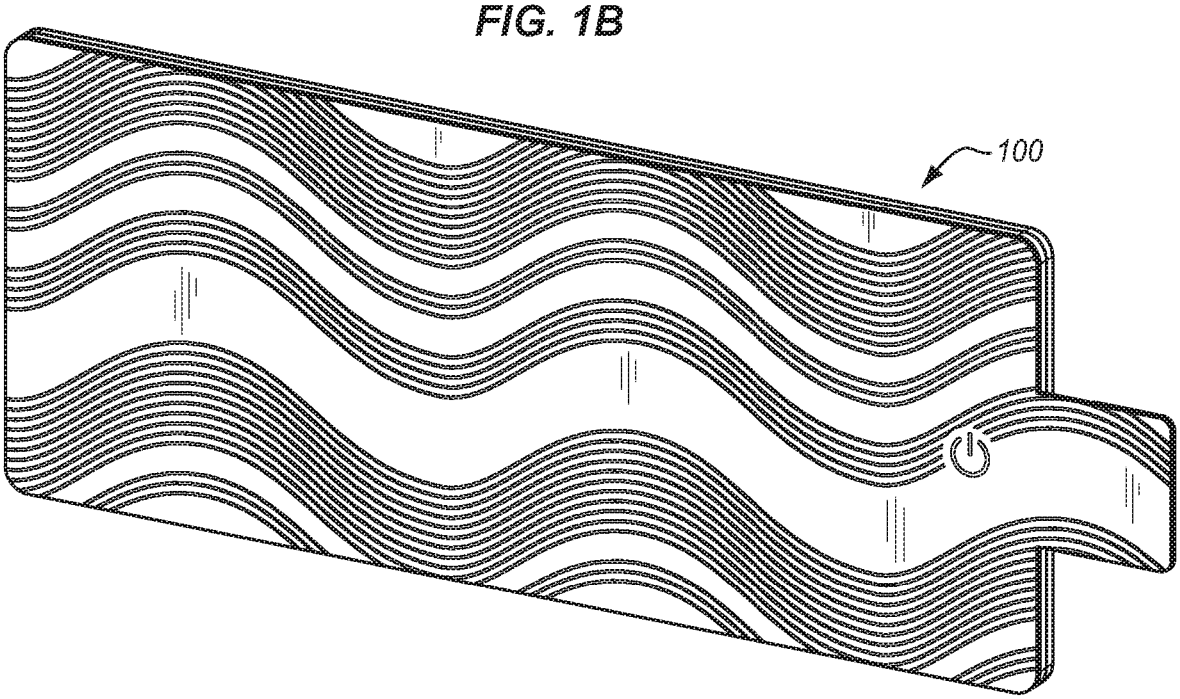
FIG. 1B shows a perspective right side view of one embodiment of the assembled device.
Figure 2:
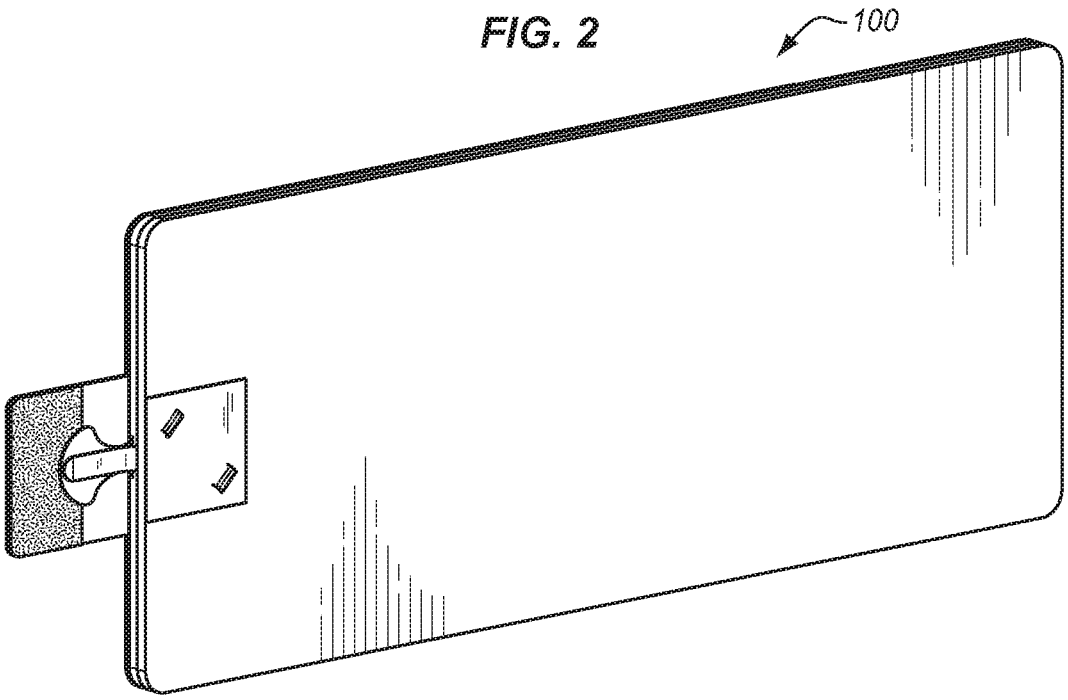
FIG. 2 shows a perspective left side view of the device of FIG. 1B.
Figure 3:
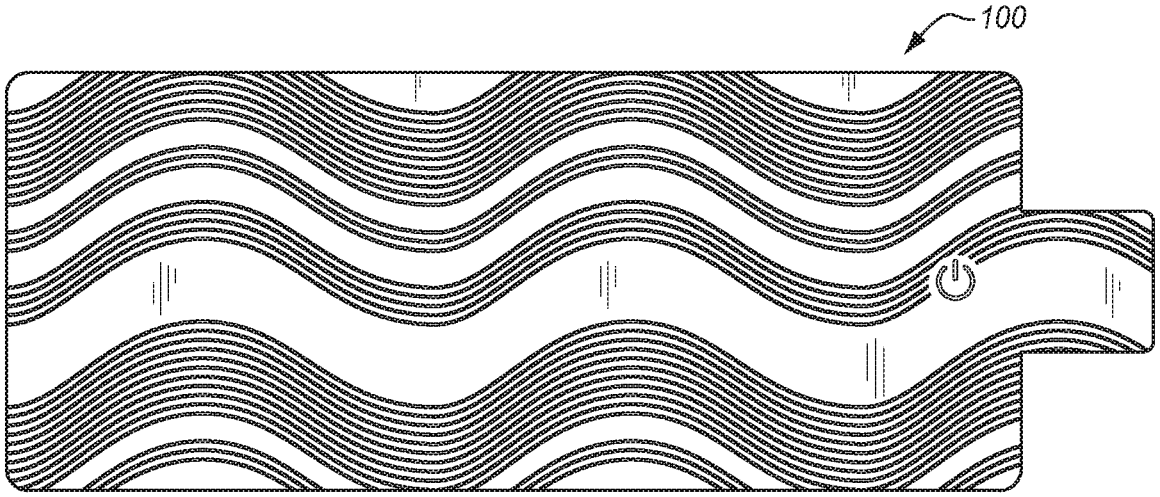
FIG. 3 shows a right-side view of the device.
Figure 4:
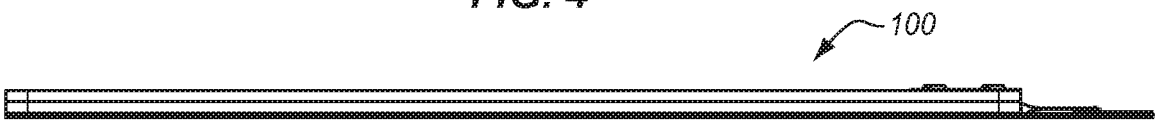
FIG. 4 shows a top view of the device.
Figure 5:
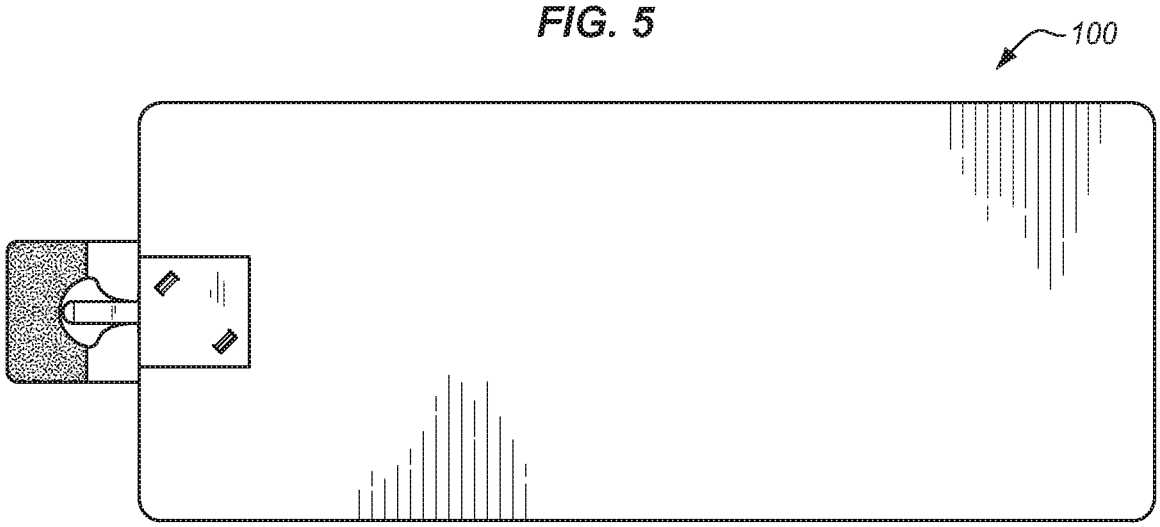
FIG. 5 shows a left-side view of the device.
Figure 6:
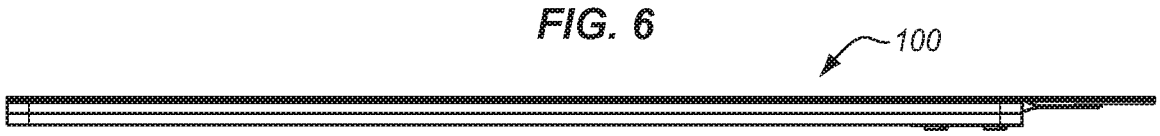
FIG. 6 shows a bottom view of the device.
Figure 7:
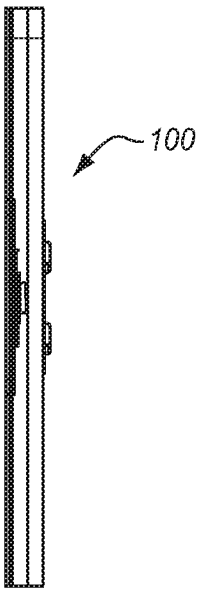
FIG. 7 shows a left edge view of the device.
Figure 8:
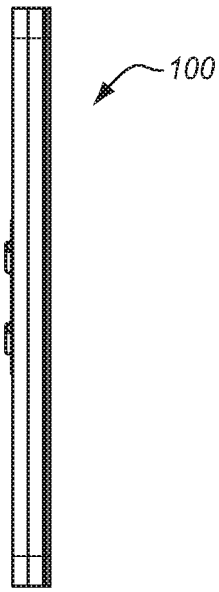
FIG. 8 shows a right edge view of the device.

FIG. 1B shows a perspective right side view of one embodiment of the assembled device. FIG. 2 shows a perspective left side view of the device of FIG. 1B. FIG. 3 shows a right-side view of the device. FIG. 4 shows a top view of the device. FIG. 5 shows a left-side view of the device. FIG. 6 shows a bottom view of the device. FIG. 7 shows a left edge view of the device. FIG. 8 shows a right edge view of the device.

While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

What is claimed as new and desired to be protected by Letters Patent of the United States is:

1. A beverage container lighting and insulation device, comprising:

a first piece of insulating material;

a shell connected to the first piece of insulating material;

a flat spring oriented along a length of the first piece of insulating material and movable between a straight configuration and a coiled configuration, such that the spring causes the device to wrap around a beverage container in the coiled configuration;

a joining film holding the spring to the first piece of insulating material; and a lighting device coupled to the first piece of insulating material and positioned between the first piece of insulating material and the shell, such that the lighting device lights the shell.

2. The beverage container lighting and insulation device of claim 1, wherein the lighting device includes a momentary switch.

3. The beverage container lighting and insulation device if claim 2, wherein the momentary switch is located within the device, such that a user depressing a body portion of the device actuates the momentary switch.

4. The beverage container lighting and insulation device of claim 1, wherein the lighting device includes a light transmitting material that runs the length of the first piece of insulating material and the light transmitting material is adjacent to a light in the lighting device.

5. The beverage container lighting and insulation device of claim 4, wherein the light is an LED and the light transmitting material is flexible polymer.

6. The beverage container lighting and insulation device of claim 5, wherein the lighting device includes a battery harness and a circuit board, the battery harness holding batteries under the circuit board.

7. The beverage container lighting and insulation device of claim 1, further comprising a second piece of insulating material, the first and second pieces of insulating material sandwiching the spring, wherein the joining film joins the spring and the second piece of insulating material to the first insulating material, and wherein the lighting device is positioned between the second piece of insulating material and the shell.

8. The beverage container lighting and insulation device of claim 7, wherein the spring includes a first bi-stable spring and a second bi-stable spring.

9. The beverage container lighting and insulation device of claim 8, wherein a first and second reinforcing material is located at both ends of the first and second bi-stable spring.

10. The beverage container lighting and insulation device of claim 9, further comprising:

a second joining film holding the shell to the second piece of insulating material, wherein the lighting device is removably inserted between the shell and the second piece of insulating material.

11. The beverage container lighting and insulation device of claim 10, wherein:

the lighting device is located between the second joining film and the second piece of insulating material, and the light transmitting material is located in a cutout of the second joining film.

12. The beverage container lighting and insulation device of claim 11, wherein the first insulating material and the shell are joined at one end via a hook and loop fabric system and the shell includes a tab that is part of the hook and loop fabric system, providing for the removable insertion of the lighting device between the shell and the second insulating material.

13. A beverage container lighting and insulation device, comprising:

a first piece of insulating material;

a shell connected to the first piece of insulating material;

a first flat bi-stable spring and a second flat bi-stable spring, oriented along a length of the first piece of insulating material and each movable between a straight configuration and a coiled configuration, such that the first and second bi-stable springs cause the device to wrap around a beverage container in the coiled configuration;

a joining film holding the first and second bi-stable springs to the first piece of insulating material; and a lighting device coupled to the first piece of insulating material and positioned between the first piece of insulating material and the shell, such that the lighting device lights the shell.

14. The beverage container lighting and insulation device of claim 13, wherein the lighting device includes a momentary switch and the momentary switch is located beneath the first piece of insulating material, such that a user presses on the first piece of insulating material to actuate the momentary switch.

15. The beverage container lighting and insulation device of claim 14, wherein the lighting device includes a light transmitting material that runs the length of the first piece of insulating material and the light transmitting material is adjacent to a light in the lighting device and the light is an LED and the light transmitting material is flexible polymer.

16. The beverage container lighting and insulation device of claim 15, wherein a first and second reinforcing material is located at both ends of the first and second bi-stable spring.

17. The beverage container lighting and insulation device of claim 16, further comprising:

a second piece of insulating material, and a second joining film holding the shell to the second piece of insulating material, wherein the lighting device is removably positioned between the shell and the second piece of insulating material, and wherein the light transmitting material is located in a cutout of the second joining film.

18. The beverage container lighting and insulation device of claim 17, wherein the first insulating material and the shell are joined at one end via a hook and loop fabric system and the shell includes a tab that is part of the hook and loop fabric system, providing for the removable insertion of the lighting device.

19. A method of insulating a beverage container, the method comprising:

providing a beverage container lighting and insulation device, including:

a first piece of insulating material;

a second piece of insulating material;

a shell connected to the second piece of insulating material;

a first flat bi-stable spring and second flat bi-stable spring positioned between the first and second pieces of insulating material, the first and second bi-stable springs oriented along a length of the first and second pieces of insulating material and each movable between a straight configuration and a coiled configuration, such that the first and second bi-stable springs cause the first piece of insulating material, the second piece of insulating material, and the shell to wrap around a beverage container in the coiled configuration;

a first joining film holding the second piece of insulating material and the first and second bi-stable springs to the first piece of insulating material;

a second joining film holding the shell to the second piece of insulating material; and a lighting device removably inserted between the shell and the second piece of insulating material, such that the lighting device lights the length of the shell;

wrapping the beverage container lighting and insulation device around a beverage container; and securing the beverage container lighting and insulation device with a force provided by the coiling of the beverage container lighting and insulation device and friction between the beverage container lighting and insulation device and the beverage container.

20. The method of claim 19, further comprising: activating the lighting device using a momentary switch by pushing on the shell of the beverage container lighting and insulation device.

* * * * *